US007611381B2

(12) United States Patent
Lei

(10) Patent No.: US 7,611,381 B2
(45) Date of Patent: Nov. 3, 2009

(54) ELECTRICAL CONNECTOR WITH BOARD LOCK DEVICES

(75) Inventor: Yun Lei, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/218,429

(22) Filed: Jul. 14, 2008

(65) Prior Publication Data

US 2009/0017677 A1 Jan. 15, 2009

(30) Foreign Application Priority Data

Jul. 12, 2007 (CN) ..... 2007 2 0040742

(51) Int. Cl.
*H01R 13/60* (2006.01)

(52) U.S. Cl. ..... 439/567; 439/74

(58) Field of Classification Search ..... 439/74, 439/567, 571, 572

See application file for complete search history.

(56) References Cited

U.S. PATENT DOCUMENTS 4,681,389 A 7/1987 Nakazawa et al.
5,257,948 A * 11/1993 Peterson ..... 439/571
5,478,257 A * 12/1995 Cachina et al. ..... 439/567
5,827,089 A 10/1998 Beck, Jr.
5,868,587 A 2/1999 Westlund
5,957,722 A * 9/1999 Pan et al. ..... 439/567
6,152,765 A * 11/2000 Tang et al. ..... 439/567
6,638,105 B1 * 10/2003 Wu ..... 439/567

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

An electrical connector includes an insulating base (1) defining a mounting surface (15) and a pair of receiving passageways (12) at longitudinal ends of the mounting surface. A plurality of conductive terminals (2) is secured in the insulating base (1). A pair of board lock devices (3) are retained in the base (1) and each has a body portion (30) retained in the receiving passageway (12) and a pair of locking arms (31, 32) extending downwards from the body portion (30) and out of the mounting surface (15). At least one locking arm (32) is a reverse zigzag shape and comprises a supporting portion (322) extending outward from the locking arm (32) and severs as a pivot when the pair of locking arms are pressed face-to-face.

3 Claims, 5 Drawing Sheets

ELECTRICAL CONNECTOR WITH BOARD LOCK DEVICES

BACKGROUND OF THE INVENTION

1. Field of the Invention

The present invention relates to an electrical connector, and particularly to an electrical connector having a board lock device.

2. Description of the Prior Art

U.S. Pat. Nos. 4,681,389, 5,827,089, 5,868,587 respectively disclose a board lock device for connecting an electrical connector with a printed circuit board (PCB). The board lock device has a base portion and a pair of locking arms perpendicular extending from the base portion. The pair of locking arms are in a same structure and each has a hook portion at a distal end thereof. The base portion of the board lock device is secured in the electrical connector and the locking arms expose outwardly. When the electrical connector is mounted onto the PCB, the pair of locking arms are pressed inwardly and the distance between the hook portions is shortened so as to surpass a corresponding receiving hole defined on the PCB. Then the locking arms are rebounding outwardly and interfering with the receiving hole, therefore the electrical connector is fixed on the PCB. However, as the appearance of the ultra thin PCB, the conventional board lock device can not offer an enough interfering force to retain the electrical connector on the PCB. Hence, a new design which can solve the problem is required.

SUMMARY OF THE INVENTION

Accordingly, an object of the present invention is to provide an electrical connector with a board lock device, and the board lock device can offer an enough interfering force to retain the electrical connector on a printed circuit board.

In order to achieve the object set forth, an electrical connector includes an insulating base defining a mounting surface and a pair of receiving passageways at longitudinal ends of the mounting surface, a plurality of conductive terminals secured in the insulating base; and a pair of board lock devices, each having a body portion retained in the receiving passageway and a pair of locking arms extending downwards from the body portion and out of the mounting surface. At least one locking arm is a reverse zigzag shape and comprises a supporting portion extending outward from the locking arm and severs as a pivot when the pair of locking arms are pressed face-to-face.

Other objects, advantages and novel features of the invention will become more apparent from the following detailed description of the present embodiment when taken in conjunction with the accompanying drawings.

DETAILED DESCRIPTION OF THE INVENTION

Figure 1:
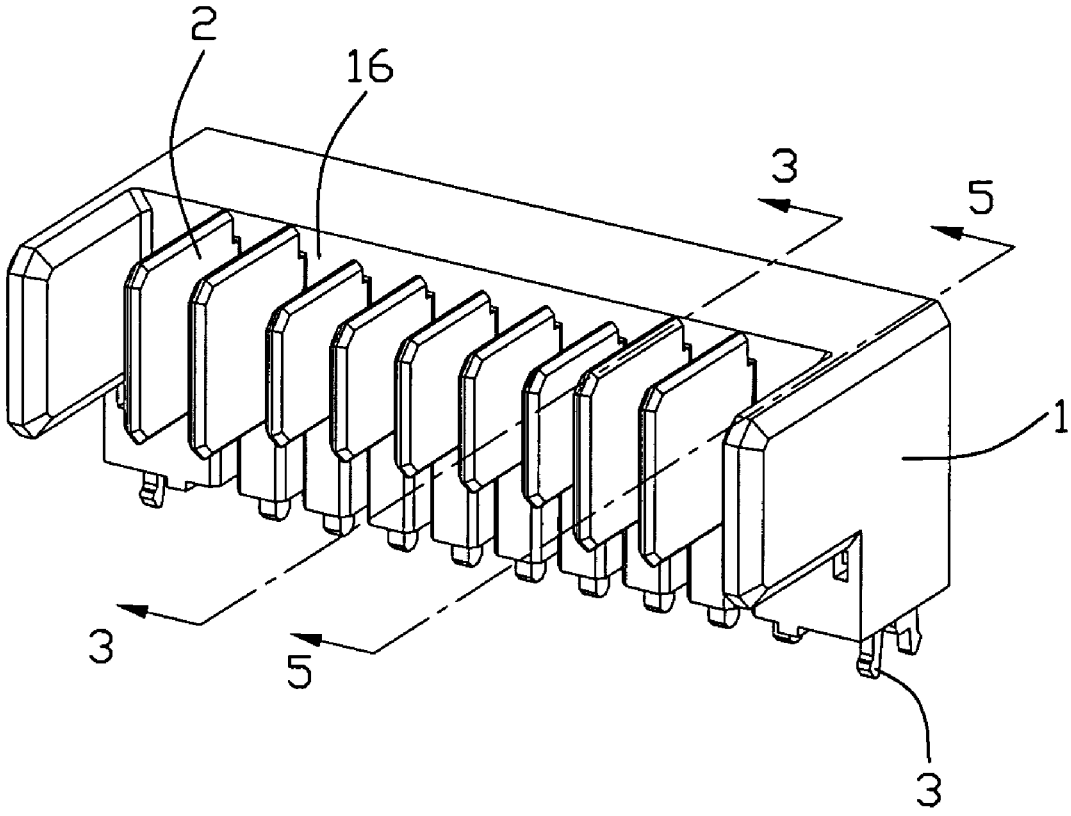
FIG. 1 is a perspective view of an electrical connector in accordance with the present invention.

Reference will now be made to the drawing figures to describe a preferred embodiment of the present invention in detail.

Referring to FIG. 1, an electrical connector in accordance with the present invention is provided and comprises an insulating base 1, a plurality of conductive terminals 2 mounted on the insulating base 1 and a pair of board lock devices 3 retained at longitudinal ends of the insulating base 1.

Figure 2:
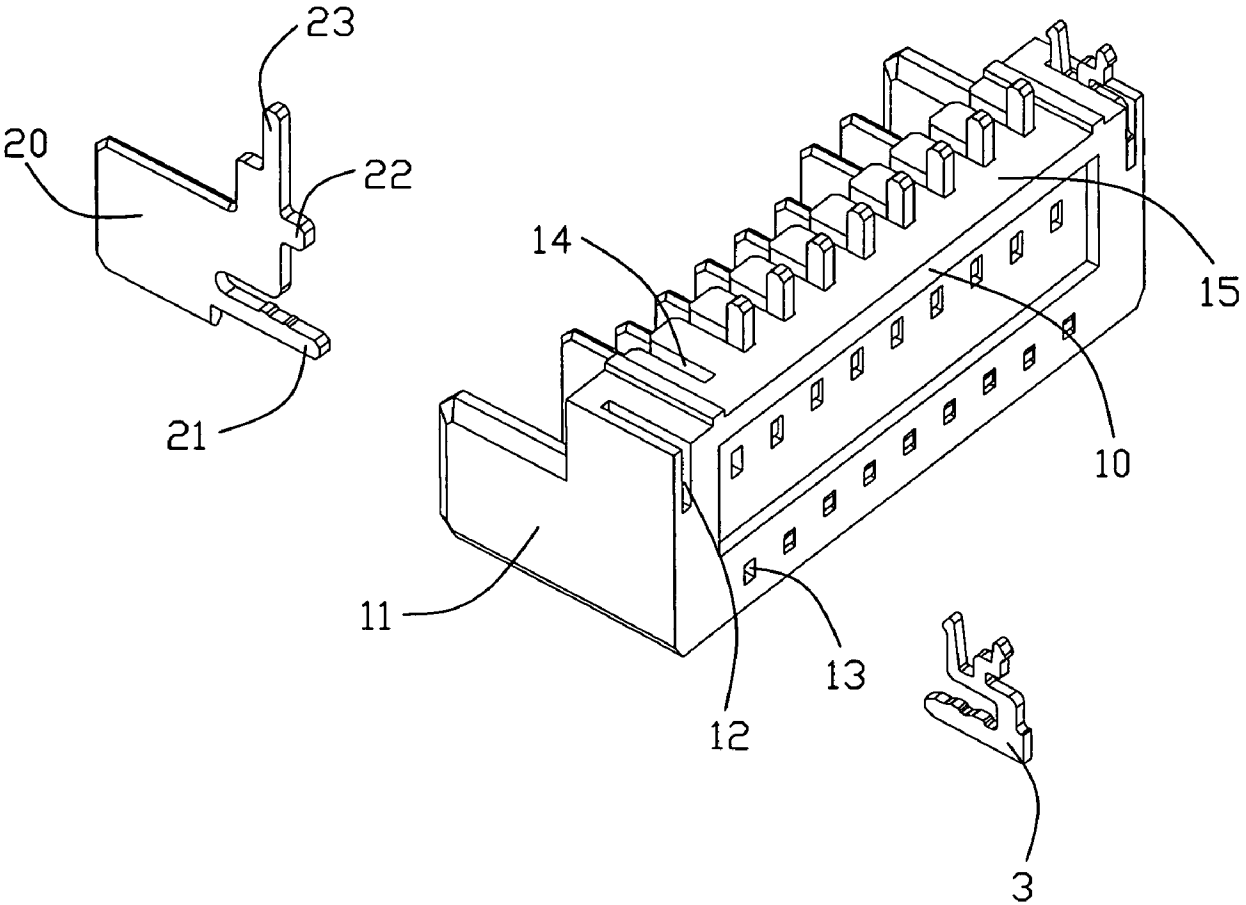
FIG. 2 is an exploded perspective view of the electrical connector shown in FIG. 1.
Figure 3:
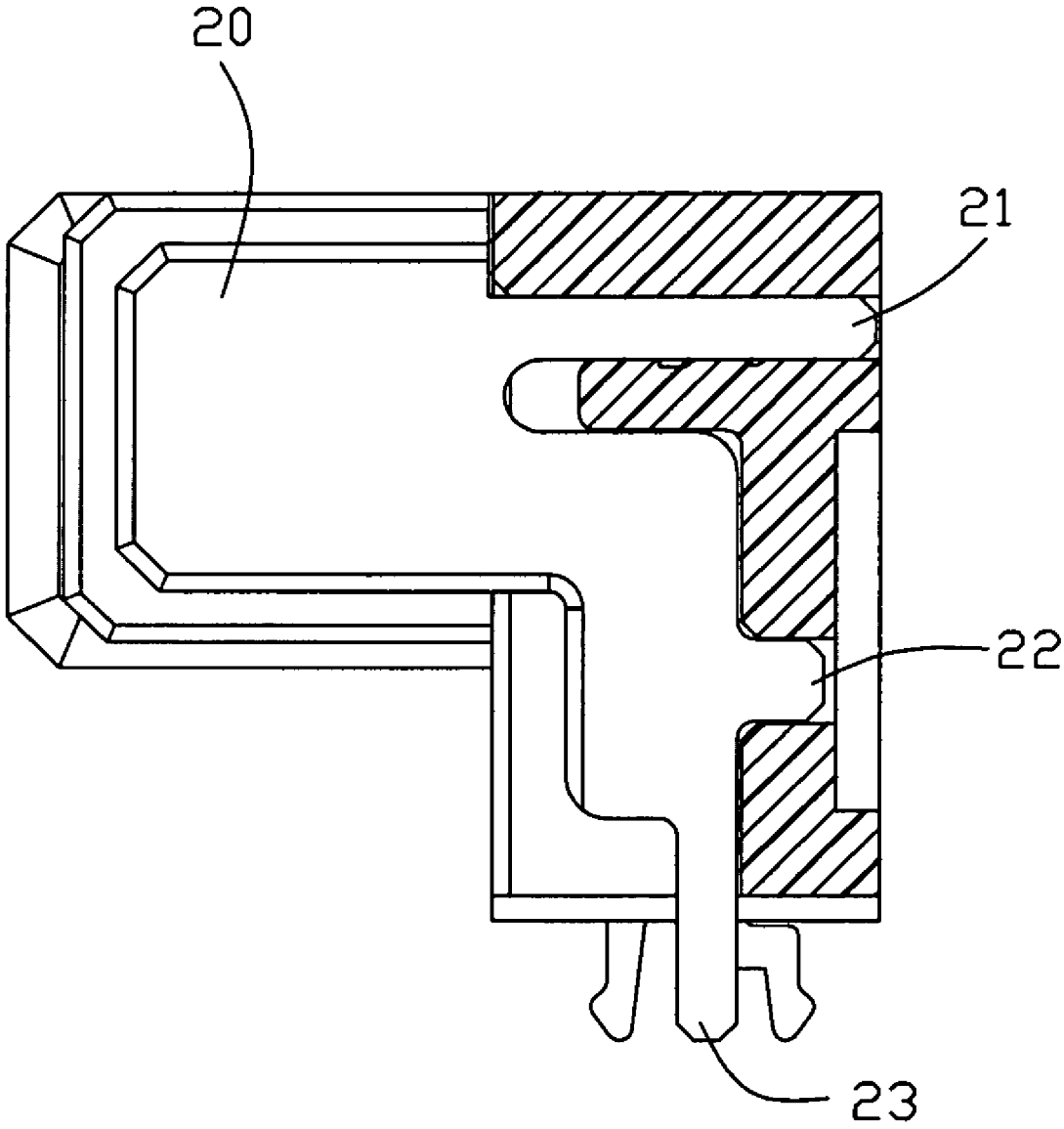
FIG. 3 is a cross sectional view of the electrical connector shown in FIG. 1 along line 3-3.

Referring to FIGS. 1 and 2, the insulating base 1 is in a rectangular shape and a front surface 16 of the base is defined as a mating surface for mating with a plug connector(not shown). A pair of plate like guiding portions 11 are perpendicular extending from opposite ends of the mating surface and a receiving space is defined therebetween. A plurality of terminal grooves 14 is arranged at a fixed interval in a longitudinal direction on the mating surface 16 and runs downwardly through a bottom wall of the insulating base 1. Each terminal groove 14 opens to the receiving space and defines a pair of holes 13 penetrating a rear wall of the insulating base 1. The bottom wall 15 of the insulating base 1 is perpendicular to the mating surface 16 and serves as a mounting surface when the electrical connector is mounted onto the printed circuit board (PCB).

Figure 5:
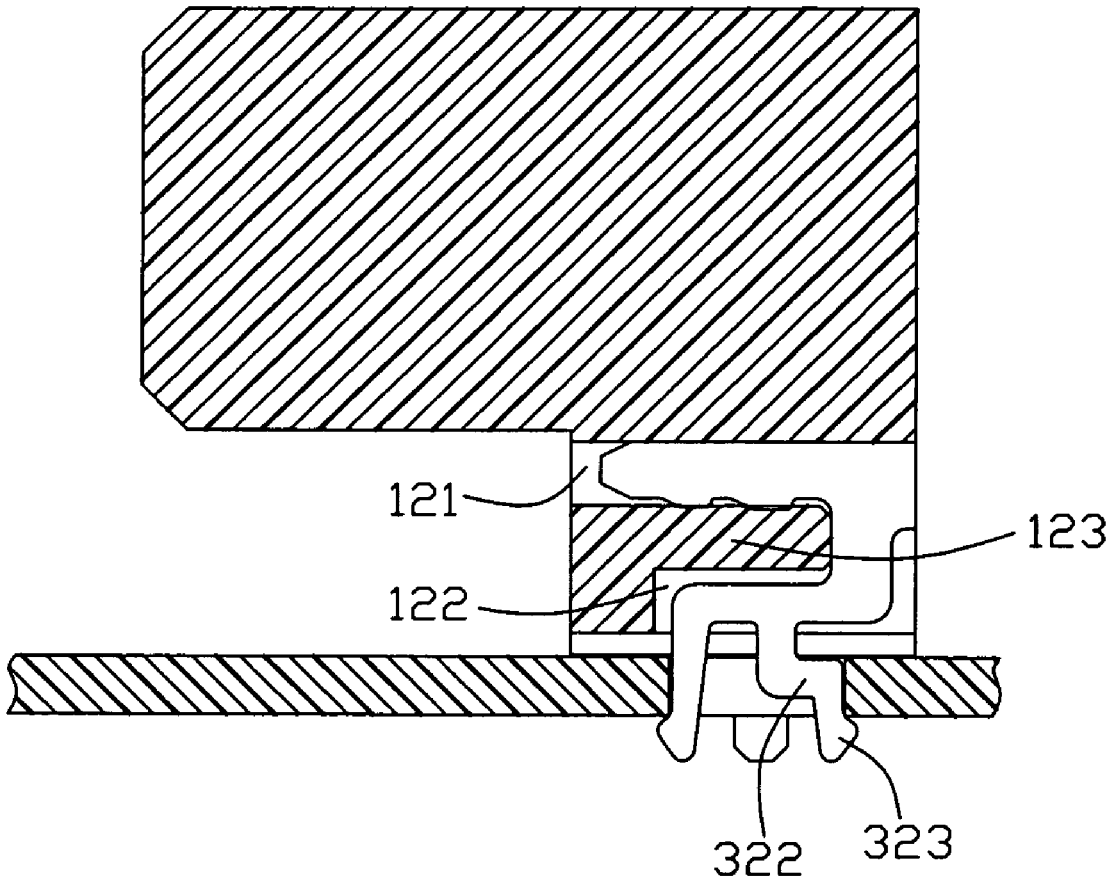
FIG. 5 is a cross sectional view of the electrical connector shown in FIG. 1 along line 5-5.

A pair of receiving passageways 12 parallel to the terminal groove 14 are respectively defined at longitudinal ends of the mounting surface 15 and open rearward. Referring to FIG. 5, each receiving passageway 12 comprises a rectangular protrusion portion 123 extending rearward from the mating surface 16 and dividing the receiving passageway 12 into a first slot 121 penetrating the mating surface 16 and a second slot 122 at opposite side of the protrusion portion 123.

Referring to FIG. 2, the conductive terminals 2 are made of metal sheets and each comprises a rectangular mating portion 20. A first and second retaining portions 21 22 are respectively formed at upper and lower portions of a rear edge of the mating portion 20 and secured in the corresponding holes defined in the terminal groove 14. A solder portion 23 extends downwardly from a bottom edge of the mating portion 20 and projects out of the mounting surface 15.

Figure 4:
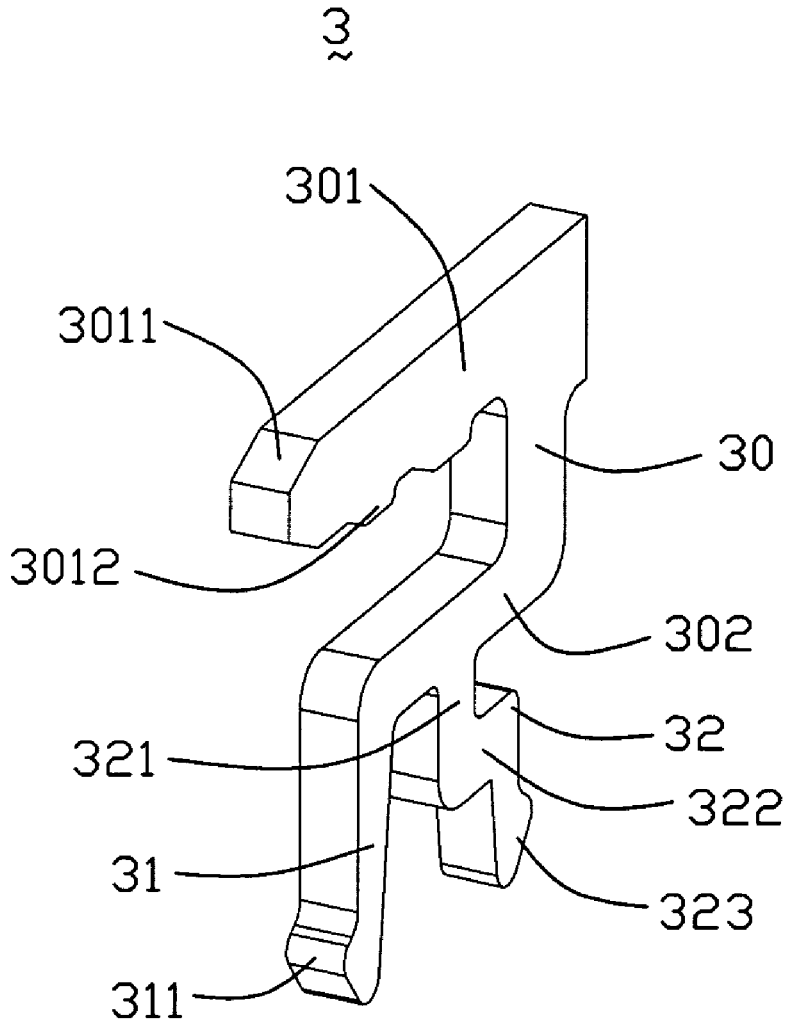
FIG. 4 is a perspective view of a board lock device of the electrical connector shown in FIG. 1.

Referring to FIGS. 4 and 5, the board lock device 3 is made of a metal sheet and comprises a reverse U shaped body portion 30. The body portion 30 has a first and second arms 301, 302 parallel to each other and defines a slot therebetween. The first arm 301 defines a slanting guiding surface 3011 at distal end thereof and forms a plurality of tips 3012 facing the slot. A first locking arm 31 perpendicular to the second arm 302 extends downward from a front end of the second arm 302 with a first hook portion 311 at a distal end thereof. A second locking arm 32 in a reverse zigzag shape extends downward from a middle portion of the second arm 302 in a perpendicular direction. The second locking arm 32 comprises a connecting portion 321 extending from the second arm 302, a supporting portion 322 extending horizontally from the connecting portion 321 and substantially parallel to the body portion 30 and a second hook portion 323 extending downward from an outward end of the supporting portion 322. The supporting portion 322 is perpendicular to the connecting portion 321 and hook portion 323.

The board lock device 3 is retained in the receiving passageway 12. The first and second arms 301, 302 are respectively secured in the first and second slots 121, 122 and the protrusion portion 123 is inserted into the slot between the first and second arms 301, 302. The first and second locking arms 31, 32 extend out of the mounting surface 15 of the insulating base. When the electrical connector is mounted onto the PCB, the first and second locking arms 31, 32 are being pressed inwardly and the first and second hook portions 311, 323 come closely so as to surpass a corresponding hole defined on the PCB, then the first and second hook portions 311, 323 rebound outwardly and press against the PCB.

During the assembly process, the supporting portion 322 severs as a pivot and made the hook portion 323 space away from the connecting portion 321, therefore the second hook portion 323 can produce a large elastic deformation, even the second hook portion 323 shifts a little distance, which will engender an enough interfering force between the second hook portion 323 and the PCB. So, the electrical connector is fixedly mounted on the PCB.

The present invention provides the board lock device 3 with an adverse Zigzag shaped locking arm 32, which can offer an enough interfering force between the board lock device and PCB. In other embodiment, the board lock device can have a pair of adverse zigzag shaped locking arms or the adverse U shaped body portion can be formed in other shapes.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating base defining a mounting surface and a pair of receiving passageways at longitudinal ends of the mounting surface;

a plurality of conductive terminals secured in the insulating base; and a pair of board lock devices, each having a body portion retained in the receiving passageway and a pair of locking arms extending downwards from the body portion and out of the mounting surface;

wherein at least one locking arm is a reverse zigzag shape and comprises a supporting portion extending outward from the locking arm and severs as a pivot when the pair of locking arms are pressed face-to-face;

wherein the body portion is a reserve U shape and comprise a first and second arms parallel to each other, the pair of locking arms extend downwardly from the second arm;

wherein the at least one locking arm comprises a connecting portion extending downward from the body portion and a hook portion extending downward from an end of the supporting portion; and wherein the supporting portion is perpendicular to the connecting portion and hook portion.

2. An electrical connector comprising:

an insulative housing defining a mounting face for mounting to a printed circuit board;

a plurality of terminals disposed in the housing; and a board lock including a retention section, and a horizontal arm from which a pair of mounting legs downwardly extend beyond the mounting face and spaced from each other for commonly mounting to a through hole in said printed circuit board; wherein at least one of said pair of mounting legs defines a lying Z-shaped configuration under a condition that a distance between lower end regions of said pair of mounting legs is much larger than that between upper end regions of said pair of mounting legs;

wherein said retention section and said horizontal arm are spaced from each other and linked by a bight to commonly form a lying U-shaped configuration; and wherein the lying Z-shaped configuration is closer to the bight than the other of the pair of mounting legs and includes an upper vertical section, a lower vertical section and a horizontal section therebetween, and said lower vertical section is located outward relative to the upper vertical section in the corresponding through hole.

3. The electrical connector as claimed in claim 2, wherein the lower end regions of said pair of mounting legs are dimensioned and configured not to be laterally engaged with each other when commonly mounted into the through hole of the printed circuit board.

* * * * *